US009475605B2

(12) United States Patent
Everett

(10) Patent No.: US 9,475,605 B2
(45) Date of Patent: Oct. 25, 2016

(54) CHILD-RESISTANT PACKAGING SYSTEMS AND METHODS

(71) Applicant: Munson Whitman Everett, Lafayette, CA (US)

(72) Inventor: Munson Whitman Everett, Lafayette, CA (US)

( * ) Notice: Subject to any disclaimer, the term of this patent is extended or adjusted under 35 U.S.C. 154(b) by 0 days.

(21) Appl. No.: 15/053,903

(22) Filed: Feb. 25, 2016

(65) Prior Publication Data

US 2016/0251107 A1 Sep. 1, 2016

Related U.S. Application Data

(60) Provisional application No. 62/126,048, filed on Feb. 27, 2015.

(51) Int. Cl.

| | |
|---|---|
| ***B65D 5/38*** | (2006.01) |
| ***B65D 77/04*** | (2006.01) |
| ***B65D 59/04*** | (2006.01) |
| ***B65D 77/22*** | (2006.01) |

(52) U.S. Cl.

CPC ..... *B65D 5/38* (2013.01); *B65D 59/04* (2013.01); *B65D 77/04* (2013.01); *B65D 77/22* (2013.01)

(58) Field of Classification Search

CPC ..... B65D 5/38; B65D 59/04; B65D 77/04; B65D 77/22

USPC ..... 206/1.5, 468, 538, 531, 540; 220/345.3

See application file for complete search history.

(56) References Cited

U.S. PATENT DOCUMENTS

| | | | | |
|---|---|---|---|---|
| 1,253,489 | A | 1/1918 | Houghland et al. | |
| 6,641,031 | B2 | 11/2003 | Evans et al. | |
| 7,708,142 | B2 | 5/2010 | Ehrlund | |
| 7,757,843 | B2 * | 7/2010 | Katsis | A24F 27/00 206/1.5 |
| 7,854,325 | B2 | 12/2010 | Bentele | |
| 8,342,330 | B2 | 1/2013 | Weston et al. | |
| 2009/0255832 | A1 | 10/2009 | Bentele | |
| 2011/0108451 | A1 | 5/2011 | Sack et al. | |
| 2011/0289884 | A1 * | 12/2011 | Guschke | A61J 1/03 53/411 |
| 2012/0012497 | A1 | 1/2012 | Weston et al. | |
| 2012/0261275 | A1 | 10/2012 | Intini | |
| 2013/0193029 | A1 | 8/2013 | Weston et al. | |
| 2013/0233756 | A1 | 9/2013 | Weston et al. | |
| 2014/0262839 | A1 | 9/2014 | Le et al. | |

FOREIGN PATENT DOCUMENTS

| | | | |
|---|---|---|---|
| EP | 0693428 | A1 | 1/1996 |
| EP | 1783058 | A1 | 5/2007 |
| WO | WO2012011941 | A1 | 1/2012 |
| WO | WO2014130941 | A2 | 8/2014 |
| WO | WO2014130941 | A3 | 8/2014 |
| WO | WO2015000896 | A1 | 1/2015 |

OTHER PUBLICATIONS

International Search Report and Written Opinion mailed May 5, 2016 in Patent Cooperation Treaty Application No. PCT/US2016/019632 filed Feb. 25, 2016 (pp. 1-11).

* cited by examiner

*Primary Examiner* — King M Chu
(74) *Attorney, Agent, or Firm* — Carr & Ferrell LLP

(57) ABSTRACT

A child-resistant package is disclosed comprising an inner tray, an outer sleeve, and a locking system. The locking system may comprise at least one locking tab, at least one locking slot for each locking tab, and an engagement point. The locking slots may be positioned on opposite sides of the outer sleeve and may be aligned with the locking tabs when the inner tray is slideably engaged with the outer sleeve such that the locking tabs engage the locking slots.

30 Claims, 19 Drawing Sheets

CHILD-RESISTANT PACKAGING SYSTEMS AND METHODS

CROSS-REFERENCE TO RELATED APPLICATION

The present application claims the benefit of U.S. Provisional Application No. 62/126,048, filed on Feb. 27, 2015, the entire disclosure of which is hereby incorporated by reference for all purposes.

FIELD OF THE INVENTION

The present disclosure pertains to packaging, and more specifically, but not by limitation, to systems and methods for child-resistant packaging.

SUMMARY OF THE INVENTION

Some embodiments of the present disclosure may be directed to a child-resistant package. The package may comprise an inner tray and an outer sleeve to receive the inner tray therein. Locking tabs may be coupled on opposite sides of the inner tray, and locking slots may be positioned on opposite sides of the outer sleeves. The locking slots may be aligned with the locking tabs when the inner tray is slideably engaged with the outer sleeve. The locking tabs may comprise memory properties to allow the locking tabs to releasably engage the locking slots when the inner tray engages the outer sleeve.

Various embodiments of the present disclosure may be directed to a child-resistant package. The package may comprise an inner tray, an outer sleeve, and a locking system. The inner tray may comprise opposing side walls and opposing end walls disposed between the side walls. The outer sleeve may comprise an opening adapted to receive the inner tray therein, and a back panel opposite the opening. The locking system may comprise at least one locking tab, at least one locking slot for each locking tab, and an engagement point. Each of the locking tabs may be hingedly coupled to each inner tray side wall and angularly disposed to the side wall. The locking slots may be positioned on opposite sides of the outer sleeve and may be aligned with the locking tabs when the inner tray is slideably engaged with the outer sleeve such that the locking tabs engage the locking slots. The engagement point may be positioned on the outer sleeve back panel.

Further embodiments of the present disclosure may comprise a child-resistant package. The package may comprise an inner tray comprising opposing side walls, opposing end walls, and a floor panel coupling the side walls and end walls. The package may further comprise at least one locking tab hingedly coupled to an upper edge of each of the inner tray side walls such that each locking tab is in a first position angularly disposed to the inner tray side wall. The locking tabs may have memory properties such that the locking tabs substantially return to the first position after being moved to a second position. In addition, the package may comprise an outer sleeve comprising opposing side walls and opposing top and bottom panels disposed between the side walls. The side walls, top panel, and bottom panel may define an opening adapted to receive the inner tray therein. The outer sleeve may also comprise an end panel having an engagement point. The package may further comprise a locking slot in each of the outer sleeve side walls adapted to receive the locking tabs therein when the inner tray is slideably engaged with the outer sleeve. Disengagement of the inner tray may require the simultaneous application of force to the locking tabs and the engagement point such that the locking tabs disengage from the locking slots and the inner tray slideably disengages from the outer sleeve.

In various embodiments, the material of the child-resistant packaging may be a paper-based product including paperboard (also known as cardboard, carton board, and solid board) and corrugated paperboard (also known as corrugated board, corrugated cardboard, and corrugated fiberboard).

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments. The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein. Various embodiments of the present technology are made by die cutting. A person of ordinary skill in the art understands die cutting is a manufacturing process used to generate a large number of the same shape from a material. Non-limiting examples of a material include wood, metal, paper, plastic, and combinations thereof. A die cut shape may be called a blank as referenced herein.

DETAILED DESCRIPTION

Figure 1:
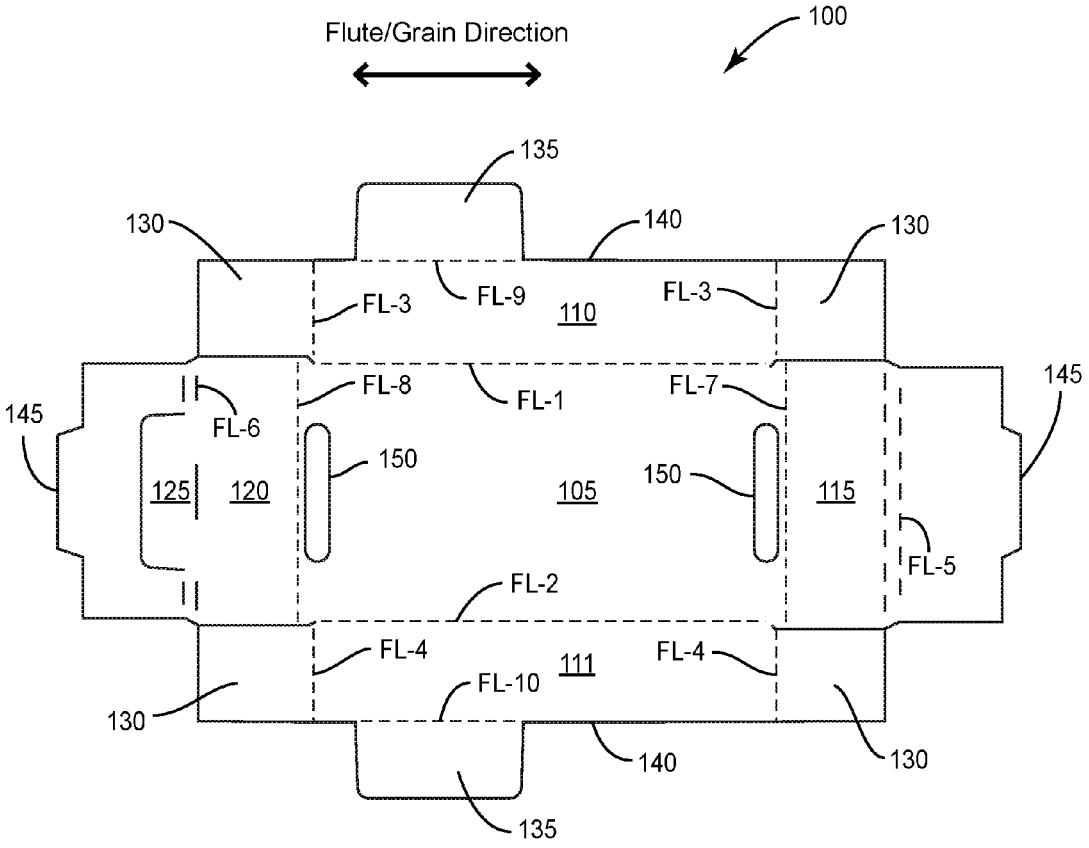
FIG. 1 is a plan view of an inner tray blank, according to various embodiments.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated. The terminology used herein is for the purpose of describing particular embodiments only and is not intended to be limiting of the technology. As used herein, the singular forms "a," "an," and "the" are intended to include the plural forms as well, unless the context clearly indicates otherwise. It will be further understood that the terms "comprises," "comprising," "includes," and/or "including," when used in this specification, specify the presence of stated features, steps, operations, elements, and/or components, but do not preclude the presence or addition of one or more other features, steps, operations, elements, components, and/or groups thereof. It will be understood that like or analogous elements and/or components, referred to herein, may be identified throughout the drawings with like reference characters. It will be further understood that several of the figures are merely schematic representations of the present technology. As such, some of the components may have been distorted from their actual scale for pictorial clarity.

Packaging for age-sensitive content requires special features such as child-resistance. A package is child-resistant if a person of inappropriate age (e.g., a child five-years-old or younger) cannot open the package, while a person of appropriate age (e.g., an adult) can conveniently open the same package. For example, a child-resistant package is locked to a five-year-old child, while being efficiently unlocked by an adult including seniors. A child-resistant package results in the contents (e.g., pharmaceuticals, medicines, etc.) of the package not being accessible to a person of inappropriate age, while being accessible to a person of appropriate age. For example, a pharmaceutical in a child-resistant package is not accessible to a five-year-old child, while being easily accessible to an adult. Various standards exist for child-resistant packaging, such as the Consumer Product Safety Commission's standards and protocols for poison prevention packaging, as set forth in the Code of Federal Regulations Title 16, Part 1700.20. Additional child-resistant packaging standards may be found in the Federal Insecticide, Fungicide, and Rodenticide Act (FIFRA) section 25 (c)(3), located at 40 Code of Federal Regulations 157 subpart B. Additionally, standards development organizations such as American Society for Testing and Materials (ASTM) International develops and maintains standard test methods and procedures for child-resistant packages. Various embodiments of the present technology meet the standards for poison prevention packaging according to C.F.R. Title 16, Part 1700.20. For example, after testing various embodiment of the present technology under C.F.R. Title 16, Part 1700.20, 0 children out of 50 child panelists were successful in opening the package before demonstration and 0 children were successful in opening the package following a demonstration for a total of 0 successful child panelists. This represents a child-resistant effectiveness of 100%. Furthermore, a total of 25 of the 25 seniors in the 50 to 54 year old age group were successful in opening the first package and opening and properly closing the second package, 25 of the 25 seniors in the 55 to 59 year old age group were successful, and 50 of the 50 seniors were successful in the 60 to 70 year old age group. In summary, embodiments of the present technology fulfill requirements for poison prevention packaging according to Code of Federal Regulations Title 16, Part 1700.20.

Additional features of a child-resistant package include durability so the child-resistant package can be opened and closed (i.e., locked and unlocked) many times while maintaining child-resistance.

Various embodiments of the present disclosure may comprise child-resistant features for packaging. Child-resistance may be enabled by "memory" properties of the material used to make the child-resistant packaging. "Memory" properties are characteristics that enable locking and unlocking (i.e., opening and closing) of a child-resistant package (hereinafter Memory Properties). In some embodiments, the material with Memory Properties may comprise a paper-based product including, but not limited to, paperboard, corrugated paperboard, and the like. In various embodiments, the material with Memory Property may comprise synthetic materials such as plastics, polymers, and the like. For example, plastic materials include products such as Polypropylene (PP), Polyethylene (PE), Polyvinylchloride (PVC), Polyesterterephtalate (PET), and Polylactic acid (PLA) that may be made from renewable sources. In still further embodiments, the material with Memory Properties may comprise more than one type of material, such as a combination of paper and plastic materials. In various embodiments, the material may be any material with Memory Properties.

In various embodiments, the present technology of child-resistant packaging is made from paper, paperboard, corrugated paperboard, heavy solid board, and semi-rigid plastics. A person of ordinary skill in the art understands that paper is a fiber-based material produced from wood, rags, or other organic material. A person of ordinary skill in the art understands paperboard is the name for a range of paper based materials that includes but is not limited to folding box board (FBB), solid bleached board (SBB), solid unbleached board (SUB), white lined chipboards (WLC), some unlined chipboards, and certain laminated boards. A person of ordinary skill in the art understands corrugated paperboard is manufactured by combining lining paper with a fluting medium in a unit called a single facer. The liners used may be made from recycled, test, or kraft papers, and consequently may have a brown or white surface, which may be coated or semi-coated, depending on the application for which they are used. The fluting medium may be recycled paper. For example, in the single facer unit, heat, steam, and a corrugating roller may be used to corrugate the fluting medium, which then has the liner attached. This creates single face, the basic building block of all corrugated board. Single face may be used as is for some specific applications and also may be combined with further liners and fluting media to produce single wall corrugated (single face plus a top liner), double wall (single wall plus single face), or multi-wall (further combinations of the above). The thickness of the corrugated material will depend on the fluting height created by the single facer and the combination of flutings used. The non-limiting range of thicknesses may vary from 0.5 mm for the finest, up to 15 mm for the thickest, and sometimes more.

In exemplary embodiments of the present disclosure, the material with Memory Properties may be corrugated paperboard (also known as corrugated board, corrugated cardboard, and corrugated fiberboard). As understood by a person of ordinary skill in the art, corrugated paperboard is a paper-based material made from a fluted corrugated sheet and flat linerboard(s) (usually one or two flat linerboards). The fluted corrugated sheet may have sheets of different sizes that refer to the number of flutes per liner foot or flutes per linear meter. Common flute sizes are "A," "B," "C," "D," "E," "F," "G," "N" and microflute where the letter designation indicates flute size. A person of ordinary skill in the art recognizes that flute size refers to the number of flutes per linear meter and various flute thicknesses, although the actual flute dimensions for different manufacturers may vary. A person of ordinary skill in the art understands the following flute sizes: flute size "A" is approximately 108+/−10 flutes per linear meter, flute size "B" is approximately 154+/−10 flutes per linear meter, flute size "C" is approximately 128+/−10 flutes per linear meter, flute size "D" approximately is 208+/−13 flutes per linear meter, flute size "E" is approximately 295+/−13 flutes per linear meter, flute size "F" is approximately 420+/−13 flutes per linear meter, flute size "G" is approximately 550+/−13 flutes per linear meter, flute size "N" is approximately 572+/−13 flutes per linear meter, and microflute (also known as "E"). Significantly, the direction of the flutes in the corrugated sheet gives the corrugated paperboard unique properties when it is folded. For example, folding a corrugated sheet against the direction of the flutes (that is, essentially perpendicular to the direction the flutes run) gives the corrugated sheet Memory Properties such that the sheet tends to return to its original pre-bended shape. Thus, proper selection of the flute size and corrugated construction can impart spring-like properties (i.e., Memory Properties) to the material. Some embodiments of child resistant packaging have optimal Memory Properties with memory tabs made from corrugated paperboard with "A," "B," "C," and "D," flute size.

In various embodiment of the present technology, corrugated paperboard may be specified by the construction and/or flute size as well as other characteristics. The choice of corrugated medium, flute size, combining adhesive, and linerboards (e.g., single face, single wall, double wall, etc.) can be varied to engineer a corrugated board with specific properties including but not limited to burst strength, edge crush strength, flat crush, basis weights of components (pounds per thousand square feet, grams per square meter, etc.), and surface treatments, coatings, and the like. The properties of corrugated paperboard can be engineered to match a wide variety of uses including the requirements for the contents of a child-resistant package such as temperature tolerance, crush resistance, durability, strength, and the like. For example, the contents of a child-resistant package may require storage in a freezer so the corrugated paperboard may be designed with surface treatment and coating to tolerate cold temperatures. As understood by a person of ordinary skill in the art, strength of corrugated matter may be determined by the Bursting Test (also known as the Mullen Test), which is related to the rough handling durability of corrugated material. The Bursting Test is a measure of the force required to rupture or puncture the face of corrugated board and may be measured by a Mullen Tester. This force is indirectly related to the ability of a carton made from corrugated material to withstand external or internal forces and thus to contain and protect a product during shipment. For example, bursting strength is reported in pounds. For example, bursting strength of 275 pounds is 275#. Some embodiments of the present technology have optimal Memory Properties with memory tabs made from 31#, 35# and 42# corrugated paperboard.

In exemplary embodiments of the present technology, the material with Memory Properties may be paperboard (also known as cardboard, carton board, and solid board). As understood by a person of ordinary skill in the art, the direction of fibers in a sheet of paperboard is generated during paperboard formation. As paperboard moves forward along the forming wire on a papermaking machine, the fibers align themselves in a direction parallel to the direction of wire travel through the machine (also called machine direction). When paperboard is cut into sheets, the sheets will be either long-grain (or grain-long) if the fibers are aligned parallel to a sheet's longer dimension, or short-grain (or grain-short), if the fibers are aligned parallel to a sheet's shorter dimension. Paperboard will tear and fold more easily with the grain and with greater difficulty against the grain. For example, folding a paperboard sheet against the direction of the grain (that is, essentially perpendicular to the direction the grain) gives the paperboard sheet Memory Properties such that the paperboard sheet tends to return to its original pre-bended shape. Thus, folding a paperboard sheet against the grain can impart spring-like properties (i.e., Memory Properties) to the paperboard sheet.

In various embodiments paperboard used for the present technology is selected for its Memory Properties. As understood by a person of ordinary skill in the art, in the United States thickness (also referred to as "caliper") is usually expressed in thousandths of an inch (0.001") or points (pt), where a sheet of paperboard with a thickness of 0.024" would be 24 points. For example, non-limiting thickness of various embodiments are 12 pt to 40 pt (and higher). Some embodiments of child resistant packaging have optimal Memory Properties with memory tabs made from paperboard 12 pt to 30 pt.

Figure 9:
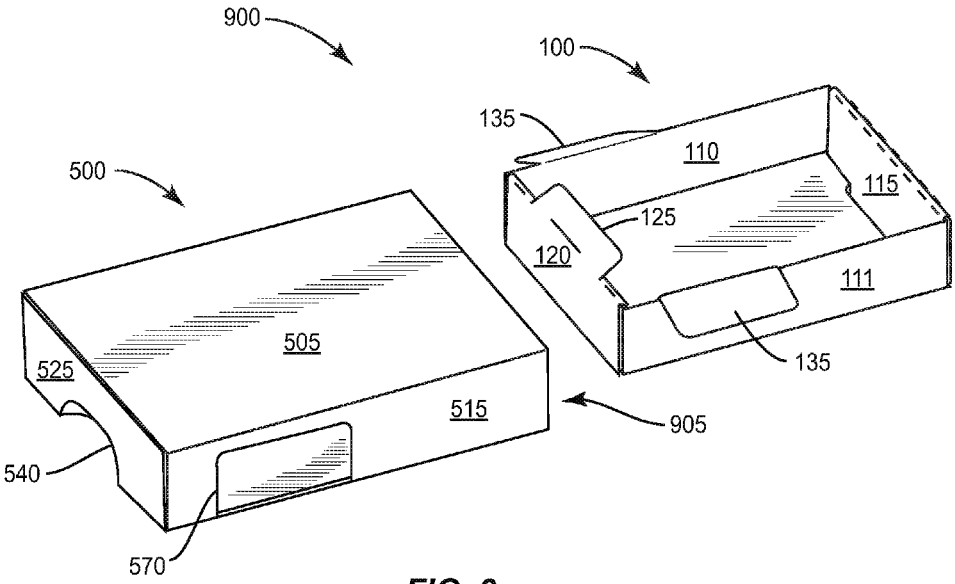
FIG. 9 is a perspective view of an inner tray and an outer sleeve, according to various embodiments.

Various embodiments of the present disclosure may comprise a child resistant package comprising an inner tray, an outer sleeve to contain the inner tray, and an engageable/disengageable locking system to secure the inner tray within the outer sleeve (see, for example, FIG. 9). FIG. 1 illustrates an exemplary die cut blank for an inner tray 100. The precise overall shape of the blank, as well as the precise shape of each component of the blank, may be varied for each particular use of the child-resistant package, as well as for design aesthetics. One skilled in the art will readily recognize that the shapes and specific components illustrated in this disclosure for the blanks may have significant variability without departing from the scope of the disclosure. The die cut blank of FIG. 1 may comprise a floor panel 105. The floor panel 105 may be coupled to opposing first side wall 110 and second side wall 111 along fold lines FL-1 and FL-2, respectively. At each end of the first side wall 110, end tabs 130 may be coupled along fold lines FL-3. Similarly, end tabs 130 may be coupled to the second side wall 111 along fold lines FL-4. Along an edge 140 of each of the first and second side walls 110, 111 (which will become an upper edge 140 of the inner tray 100 as will become evident in the discussion below), at least one locking tab 135 may be coupled along fold lines FL-9 and FL-10, respectively. The floor panel 105 may also be coupled to opposing first end panel 115 and second end panel 120 along fold lines FL-7 and FL-8, respectively. Each of the first end panel 115 and second end panel 120 may be divided approximately in half by fold lines FL-5 and FL-6, respectively. The second end panel 120 may further comprise a first tethering panel 125 at least partially cut from the second end panel 120 and coupled to the end panel 120 in proximity to the fold line FL-6. Each of the first and second end panels 115, 120 may terminate with a tab 145 adapted to engage slot 150 in the floor panel 105 as described in further detail below. A bi-directional arrow labeled "Flute/Grain Direction" shows the flute direction for corrugated material and the grain direction for paperboard, according to various embodiments of the present technology. In various embodiments for corrugated material, the locking tabs 135 are folded along fold lines FL-9 and FL-10 resulting in the locking tabs folding against the flute direction for the corrugated material. In various embodiments for paperboard, the locking tabs 135 are folded along fold lines FL-9 and FL-10 resulting in the locking tabs folding against the grain direction for the paperboard.

Figure 2:
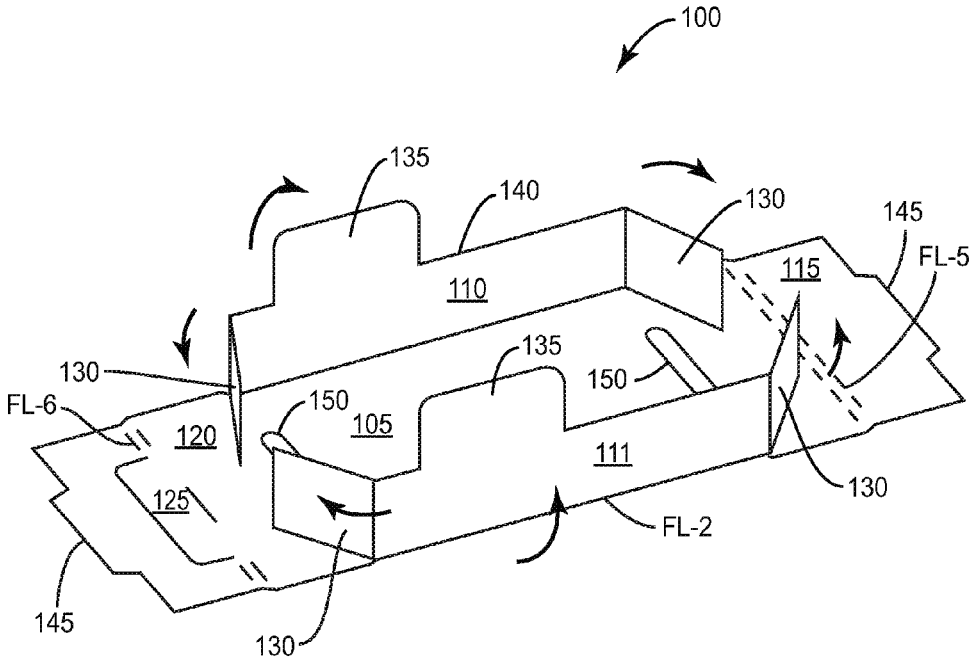
FIG. 2 is a perspective view of an inner tray blank being formed into an inner tray, according to various embodiments.
Figure 3:
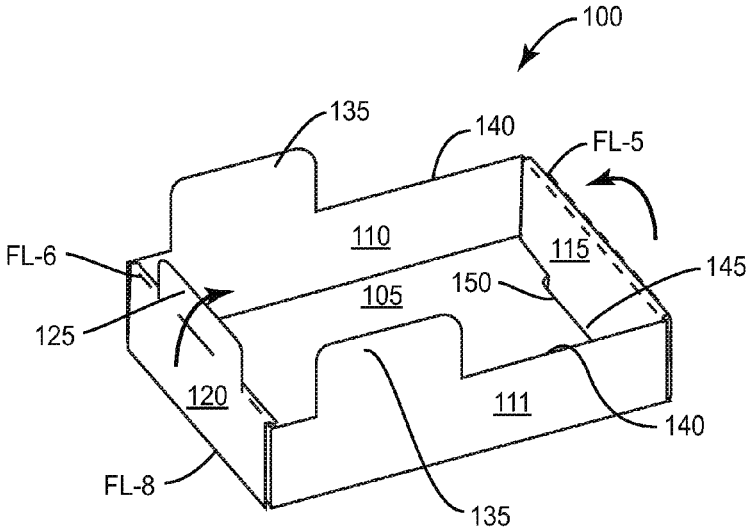
FIG. 3 is a perspective view of an inner tray blank being formed into an inner tray, according to some embodiments.
Figure 4:
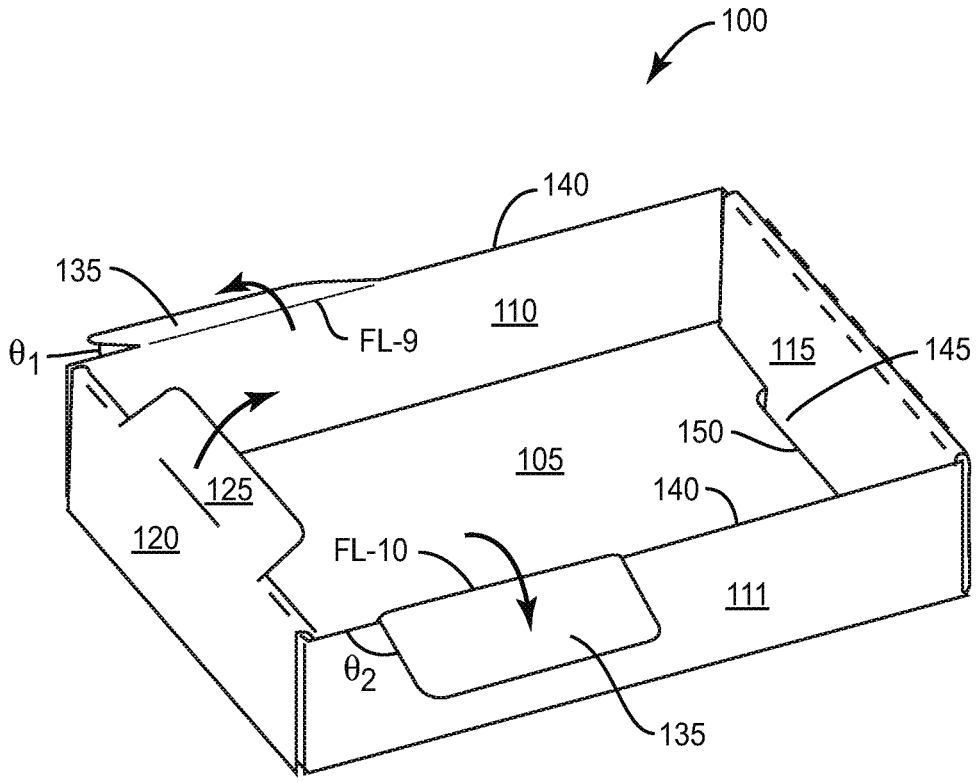
FIG. 4 is a perspective view of an inner tray blank being formed into an inner tray, according to various embodiments.

FIGS. 2-4 illustrate assembly of the inner tray 100 according to various embodiments. In FIG. 2, the first and second side walls 110, 111 may be folded along fold lines FL-1 and FL-2 so that the first and second side walls 110, 111 are substantially perpendicular to the floor panel 105. All four of the end tabs 130 may be folded inward along fold lines FL-3 and FL-4 towards the floor panel 105 so that the end tabs 130 are substantially perpendicular to the first and second side walls 110, 111 and substantially parallel to the first and second end panel fold lines FL-7, FL-8.

Referring now to FIG. 3, the first end panel 115 may be folded along fold line FL-7 and then along fold line FL-5 such that the end tabs 130 are contained within the folded over halves of the first end panel 115. The tab 145 may then be inserted into the slot 150 to secure the first end panel 115 in an upright position substantially perpendicular to the floor panel 105, as well as securing two of the end tabs 130 within the folded over halves of the first end panel 115. Similarly, the second end panel 120 may be folded along fold line FL-8, then again along fold line FL-6. The remaining two end tabs 130 may be contained within the folder over halves of the second end panel 120. The tab 145 may then be inserted into the slot 150 to secure the second end panel 120 in an upright position substantially perpendicular to the floor panel 105, as well as securing two of the end tabs 130 within the folded over halves of the second end panel 120. When the second end panel 120 is secured in this position, the first tethering panel 125 may be positioned in a substantially vertical position. In various embodiments, the first tethering panel 125 may be angled towards the first end panel 115.

Turning now to FIG. 4, the edge 140 of the first and second side walls 110, 111 may now form at least a portion of the upper edge 140 of the inner tray 100. The locking tabs 135 may be folded along fold lines FL-9 and FL-10 towards the outside of the inner tray 100 such that the locking tabs 135 are angularly disposed to the first and second side walls 110, 111. The locking tabs 135 may be oriented at an angle $\theta_1$, $\theta_2$ to the first and second side walls 110, 111, respectively. The angles $\theta_1$, $\theta_2$ may range from about 0° to about 90°.

Figure 5:
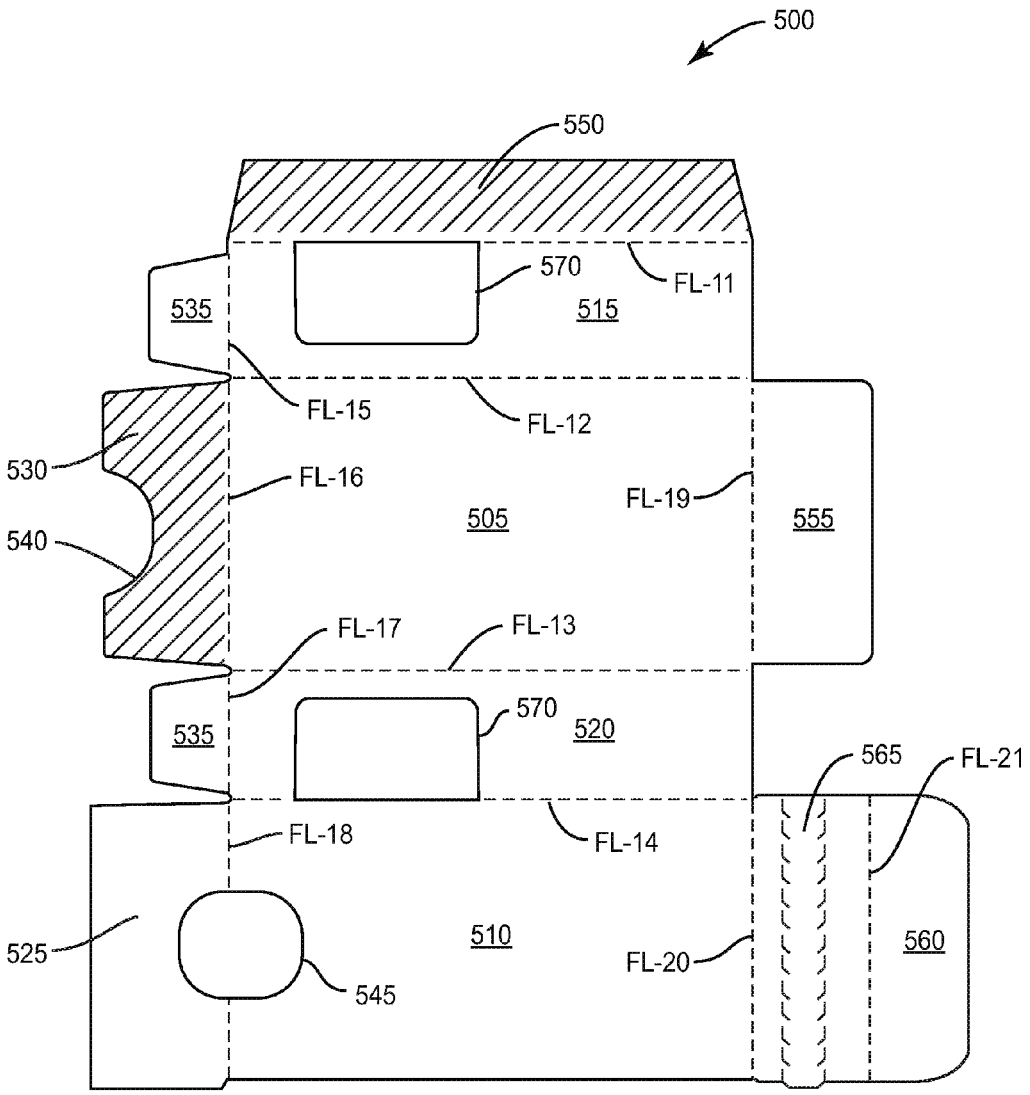
FIG. 5 is a plan view of an outer sleeve blank, according to various embodiments.

FIG. 5 illustrates an exemplary die cut blank for an outer sleeve 500. The precise overall shape of blank, as well as the precise shape of each component of the blank, may be varied for each particular use of the child-resistant package, as well as for design aesthetics. One skilled in the art will readily recognize that the shapes and specific components illustrated in this disclosure for the blanks may have significant variability without departing from the scope of the disclosure. The die cut blank of FIG. 5 may comprise an upper panel 505. A first side wall 515 may be coupled to one side of the upper panel 505 along fold line FL-12, and a second side wall 520 may be coupled to the upper panel 505 along fold line FL-13 on a side of the upper panel 505 opposite from the first side wall 515. A sealing tab 550 may be coupled to a side of the first side wall 515 along fold line FL-11 opposite the upper panel 505. The function of the sealing tab 550 will be described in further detail below. A lower panel 510 may be coupled on an opposing side of the second side wall 520 from the upper panel 505 along fold line FL-14. A first end panel 525 may be coupled to a side of the lower panel 510 along fold line FL-18. A front panel 560 may be coupled on an opposing side of the lower panel 510 from the first end panel 525 along fold line FL-20. The front panel 560 may comprise a tamper resistant feature 565 (for example, a tear away strip) that provides a visual indication that the outer sleeve 500 has been opened or at least tampered with. The front panel 560 may further comprise fold line FL-21 to facilitate sealing an end of the outer sleeve 500 by the front panel 560 as described below. A second end panel 530 may be coupled to a side of the upper panel 505 along fold line FL-16. A second tethering panel 555 may be coupled on an opposing side of the upper panel 505 from the second end panel 530 along fold line FL-19. End panel tabs 535 may be coupled to an end of the each of the first and second side walls 515, 520 along fold line FL-15 and FL-17 in proximity to the second end panel 530. The first end panel 525 may comprise an engagement point 545 which may comprise an opening positioned at least partially in the first end panel 525. The second end panel 530 may comprise a corresponding tamper resistant feature 540 that aligns with the engagement point 545 when the outer sleeve 500 is assembled. The tamper resistant feature 540 may comprise a portion of the second end panel 530 that is scored, but not removed from the second end panel. Thus, if the tamper resistant feature 540 is missing, it may serve as an indication that the package was tampered with. Each of the first and second side walls 515, 520 may comprise locking slots 570, which may comprise voids in the first and second side walls 515, 520 adapted to receive the locking tabs 135 of the inner tray 100 therein. The cross-hatched area of the blank indicates areas where an adhesive, a glue, an adhesive strip, or other chemical or mechanical attachment mechanism may be employed to assemble the outer sleeve 500 in a manner to achieve child-resistant guidelines and standards.

Figure 6:
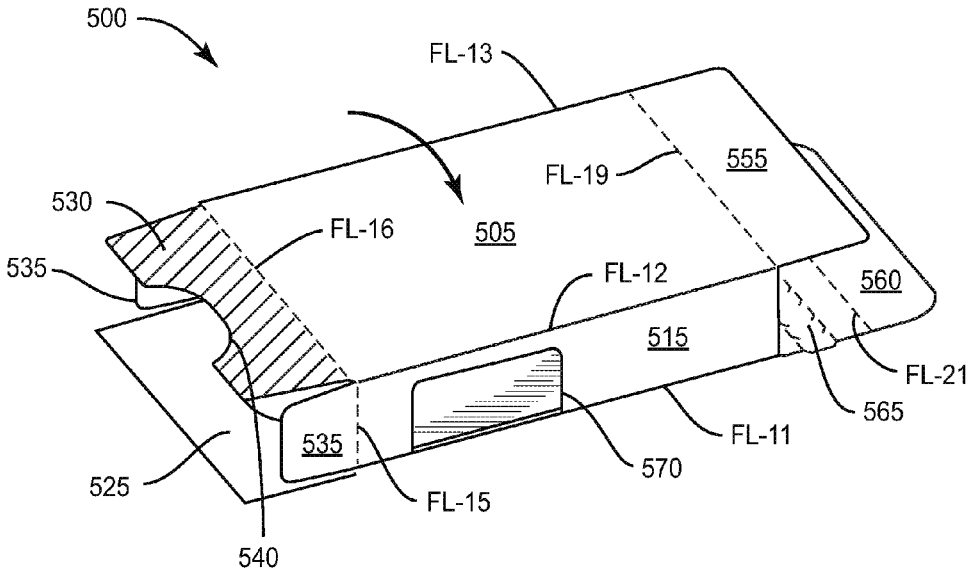
FIG. 6 is a perspective view of an outer sleeve blank being formed into an outer sleeve, according to various embodiments.
Figure 7:
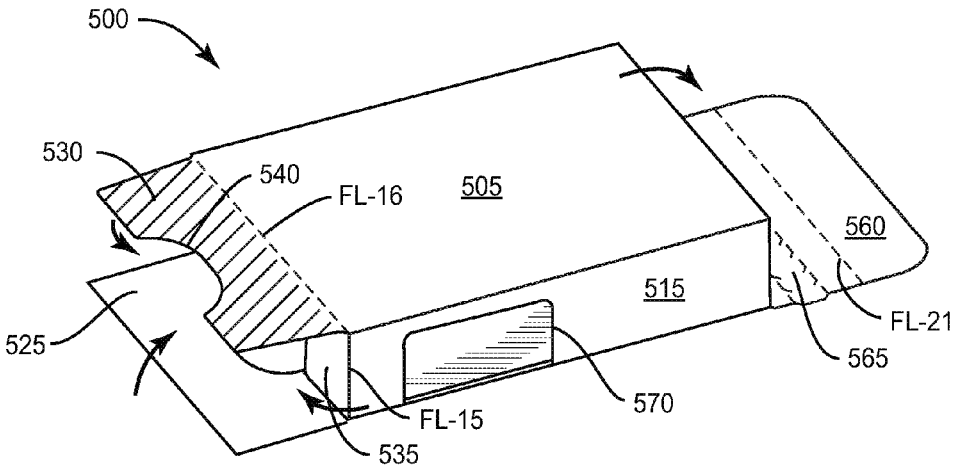
FIG. 7 is a perspective view of an outer sleeve blank being formed into an outer sleeve, according to various embodiments.
Figure 8:
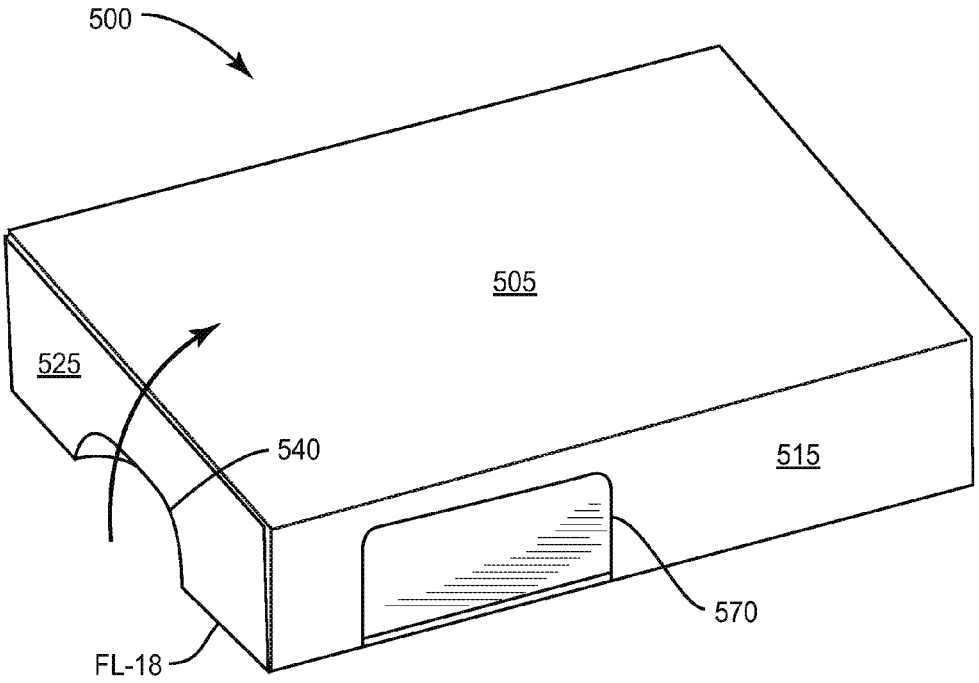
FIG. 8 is a perspective view of an outer sleeve, according to various embodiments.

FIGS. 6-8 illustrate assembly of the outer sleeve 500 according to various embodiments. In FIG. 6, the die cut of FIG. 5 may be folded along fold lines FL-12, FL-13, and FL-14 such that substantially right angles are formed at each fold line and the upper panel 505, lower panel 510, first side wall 515, and second side wall 520 form an essentially box-like structure open at each end. Although not visible in the view of FIG. 6, the sealing tab 550 may be folded along fold line FL-11 so that it makes contact with the lower panel 510 at the cross-hatched area (see FIG. 5) and is secured in place (e.g., by an adhesive).

Referring now to FIG. 7, the first end panel 525 may be folded along fold line FL-18 such that the first end panel 525 essentially covers one of the open ends of the box-like structure. Each of the end panel tabs 535 may then be folded along fold lines FL-15 and FL-17 such that the end panel tabs 535 contact the first end panel 525 and are secured in place (e.g., by an adhesive). The second end panel 530 may then be folded along fold line FL-16 (see FIG. 8) such that the second end panel 530 contacts and covers the end panel tabs 535 and the first end panel 525 and is secured in place (e.g., by an adhesive). After the inner tray 100 is inserted into the assembled outer sleeve 500 (see, for example, FIG. 12), the front panel 560 may be folded along fold line FL-20 and fold line FL-21 such that the opening in the box-like structure adjacent to the front panel 560 is covered as illustrated in FIG. 8. A portion of the front panel 560 may contact the upper panel 505 and may be secured in place (e.g., by an adhesive).

The second tethering panel 555 as illustrated in FIG. 6 may be folded along fold line FL-19 as illustrated in FIG. 7 such that the second tethering panel 555 is positioned inside the box-like structure of the outer sleeve 500 and is angularly disposed toward the first and second end panels 525, 530.

Figure 10:
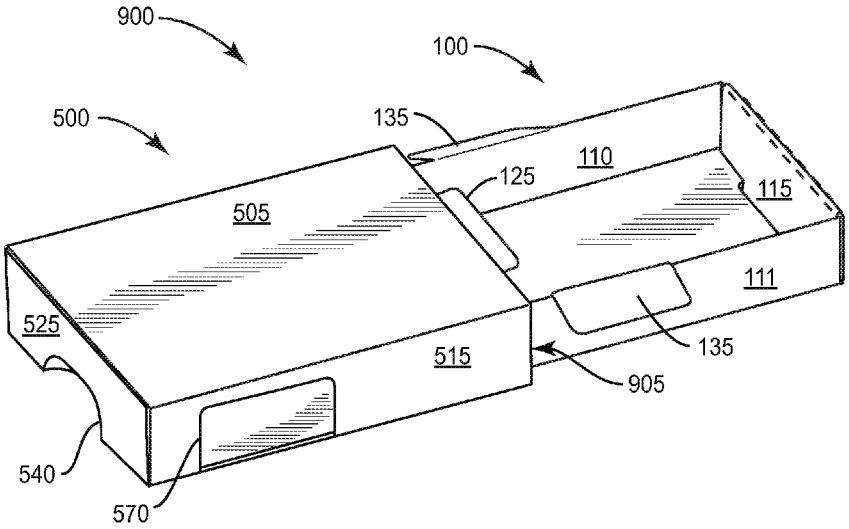
FIG. 10 is a perspective view of an inner tray partially inserted into an outer sleeve, according to various embodiments.

Turning now to FIGS. 9-12, operation of the child-resistant package 900 is illustrated according to various embodiments. FIGS. 9-12 assume that the child-resistant package 900 has been initially opened and the front panel 560 has been removed from the outer sleeve 500. The child-resistant package 900 as illustrated in FIG. 9 may comprise the outer sleeve 500 and the inner tray 100 adapted to slideably engage the outer sleeve 500. The outer sleeve 500 may comprise an opening 905 defined by the first and second side walls 515, 520 and the upper panel 505 and the lower panel 510. The inner tray 100 may be sized to fit into the opening 905 as illustrated in FIG. 10 with little or no clearance. That is, the inner tray 100 may contact one or more of the first and second side walls 515, 520 and the upper panel 505 and the lower panel 510 of the outer sleeve 500 when inserted into the outer sleeve 500, but is still able to repeatedly slide back and forth. While the fit of the inner tray 100 and the outer sleeve 500 may be considered "tight," the lack or near lack of clearance does not prevent sliding movement of the inner tray 100.

Figure 11:
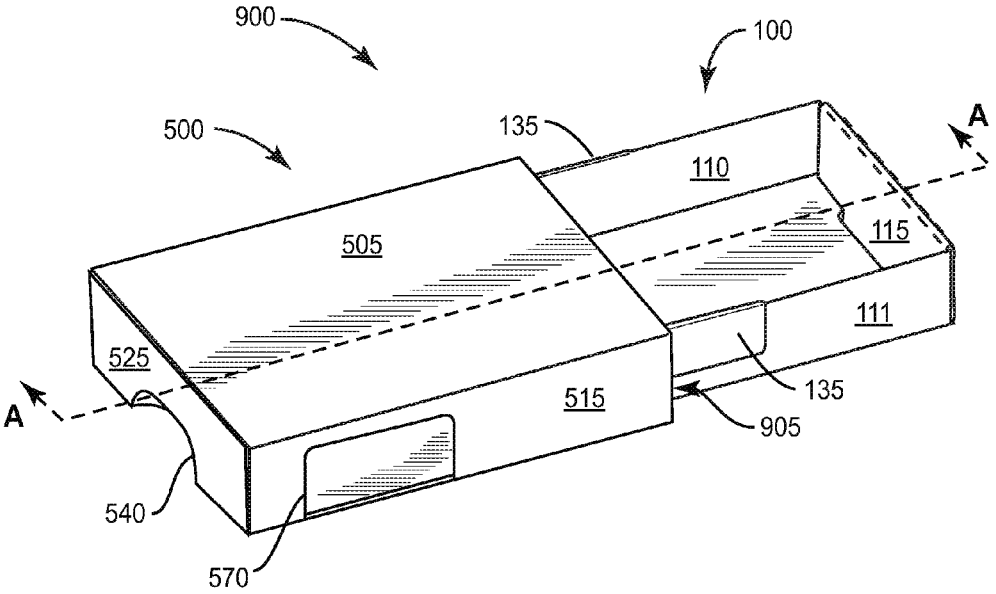
FIG. 11 is a perspective view of an inner tray partially inserted into an outer sleeve, according to various embodiments.

As the inner tray 100 is engaged further into the outer sleeve 500, the locking tabs 135, which as described previously angularly extend outward from the inner tray first and second side walls 110, 111, may contact the outer sleeve first and second side walls 515, 520 due to this angular positioning. Thus, as illustrated in FIG. 11, the locking tabs 135 may be folded flat against the inner tray first and second side walls 110, 111 to allow the inner tray 100 to continue to engage the outer sleeve 500. At this point, the locking tabs 135 may remain sandwiched between outer sleeve first and second side walls 515, 520 and the inner tray first and second side walls 110, 111 until the inner tray 100 is fully engaged with the outer sleeve 500.

Figure 12:
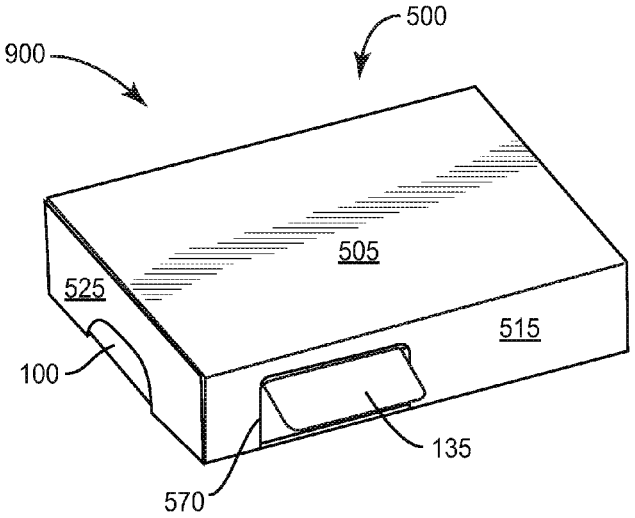
FIG. 12 is a perspective view of an inner tray inserted into an outer sleeve, according to various embodiments.

Once the inner tray 100 is fully engaged with the outer sleeve 500, the locking tabs 135 may align with the locking slots 570 in the outer sleeve first and second side walls 515, 520. Owing to the Memory Properties of the locking tabs 135, the locking tabs 135 may spring back to the previous angular orientation once aligned with the locking slots 570 as illustrated in FIG. 12. With the locking tabs 135 thus oriented in the locking slots 570, the inner tray 100 may be releasably locked within the outer sleeve 500. According to various embodiments, the locking system is operative without user intervention (other than sliding the inner tray 100 into the outer sleeve 500) by utilizing the Memory Properties of the locking tabs 135.

Figure 13:
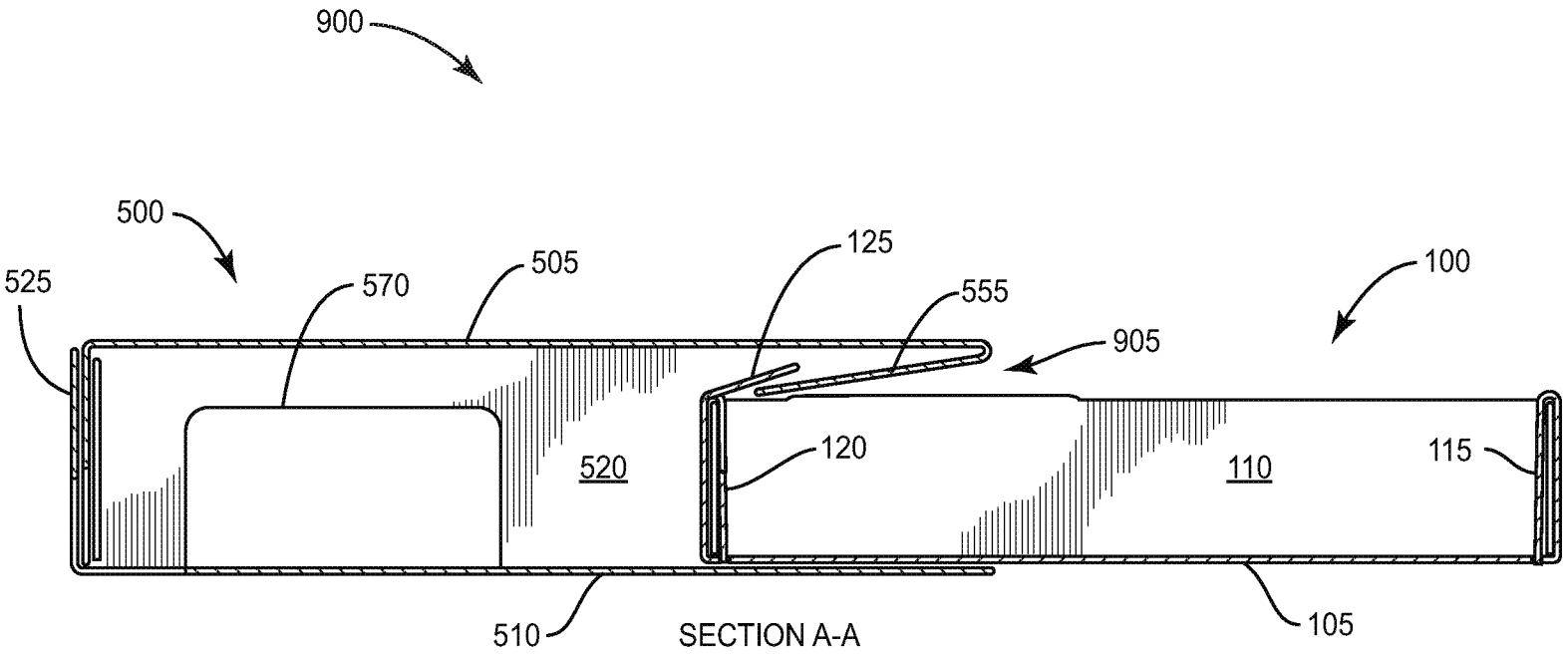
FIG. 13 is a cross-section view of a child-resistant package, according to various embodiments.

As described previously, the inner tray 100 may comprise a first tethering panel 125 and the outer sleeve 500 may comprise a second tethering panel 555. The first and second tethering panels 125, 555 may act with one another to prevent complete removal of the inner tray 100 from the outer sleeve 500 after the inner tray 100 has been initially engaged with the outer sleeve 500. The first tethering panel 125 may extend vertically upward or angularly upward from the inner tray 100, and the second tethering panel 555 may extend downward from the outer sleeve upper panel 505 in proximity to the opening 905 as illustrated in the cross-sectional view of FIG. 13 (section A-A from FIG. 11). As the inner tray 100 slides forward and outward from the outer sleeve 500, the first and second tethering panels 125, 555 may contact one another, thereby arresting further forward (outward) movement of the inner tray 100. The first and second tethering panels 125, 555 act to prevent complete removal of the inner tray 100 from the outer sleeve 500. However, the first and second tethering panels 125, 555 do not prevent the inner tray 100 from sliding inward back into a fully engaged position within the outer sleeve 500 so that the locking tabs 135 may again engage the locking slots 570 and return the child-resistant package 900 to a releasably locked state.

Figure 14:
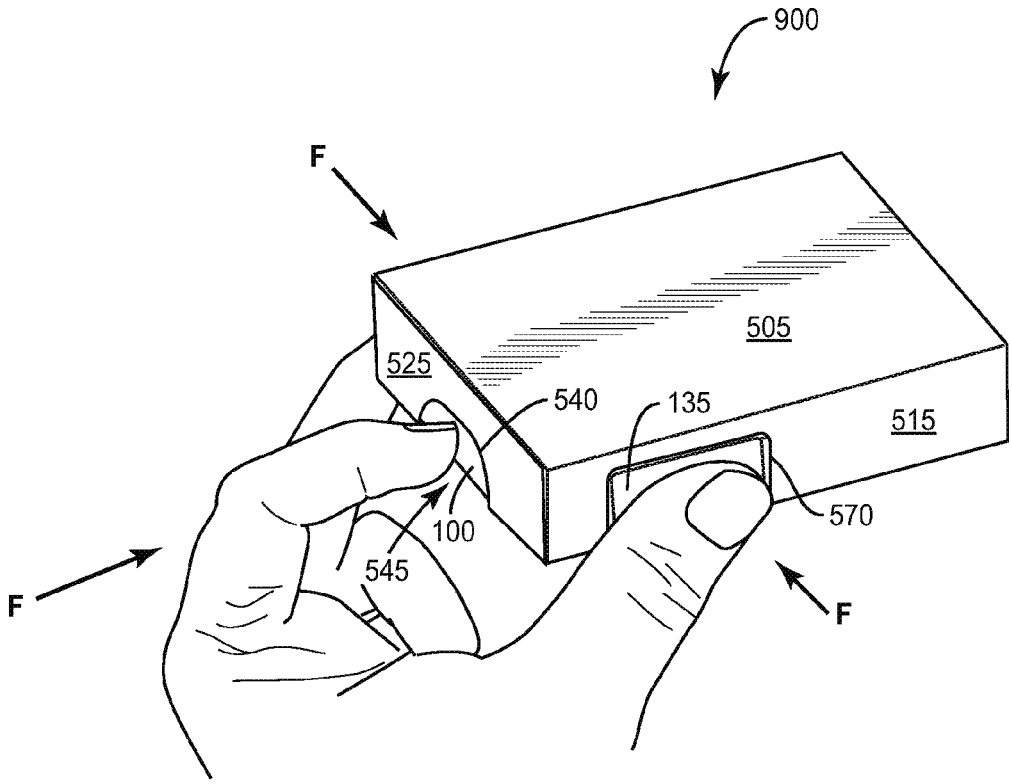
FIG. 14 is a perspective view of a child-resistant package demonstrating how to open the package, according to various embodiments.

Once the child-resistant package 900 is in the releasably locked state, the locking system may be disengaged as illustrated in FIG. 14 according to various embodiments. By way of example, a user may grasp the child-resistant package 900 in one hand and simultaneously apply forces at three separate points (as indicated by the arrows "F" in FIG. 14) to disengage the locking system. The user may apply forces to the locking tabs 135 with the thumb and middle finger such that the locking tabs 135 are held flush against the inner tray first and second side walls 110, 111. Simultaneously, the user may apply force with the index finger at the engagement point 545, which may urge the inner tray 100 forward and outward from the outer sleeve 500, thereby disengaging the locking system. As the index finger moves the inner tray 100 forward, the locking tabs 135 may again be sandwiched between the inner tray first and second side walls 110, 111 and the outer sleeve first and second side walls 515, 520 so that the forward movement of the inner tray 100 may continue until the first and second tethering panels 125, 555 engage.

Figure 15:
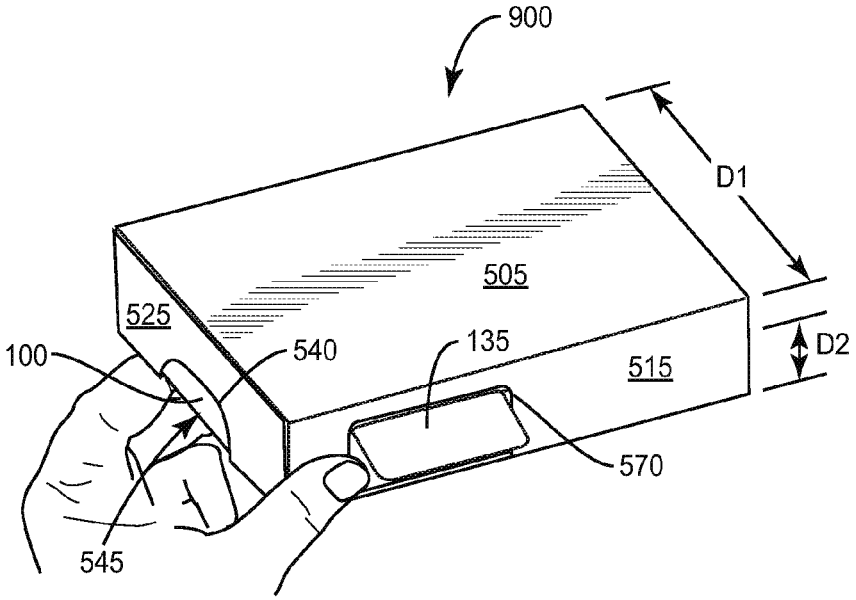
FIG. 15 is a perspective view of a child-resistant package demonstrating that a child's hand cannot open the package, according to various embodiments.

In order to further the child-resistant features of the child-resistant package 900, a distance between the locking slots 570 may be chosen such that a child's hand is not large enough to simultaneously apply force to both locking tabs 135 and the engagement point 545 as illustrated in FIG. 15. In various embodiments, the distance D1 between the locking slots 570 may be at least about 3 inches. In addition, a distance D2 of the vertical placement of the locking slots 570 from the lower panel 510 may further impede the ability of a child to simultaneously reach all three points of the locking system. In various embodiments, the distance D2 from the lower panel 510 may be at least about 0.5 inch.

Figure 16:
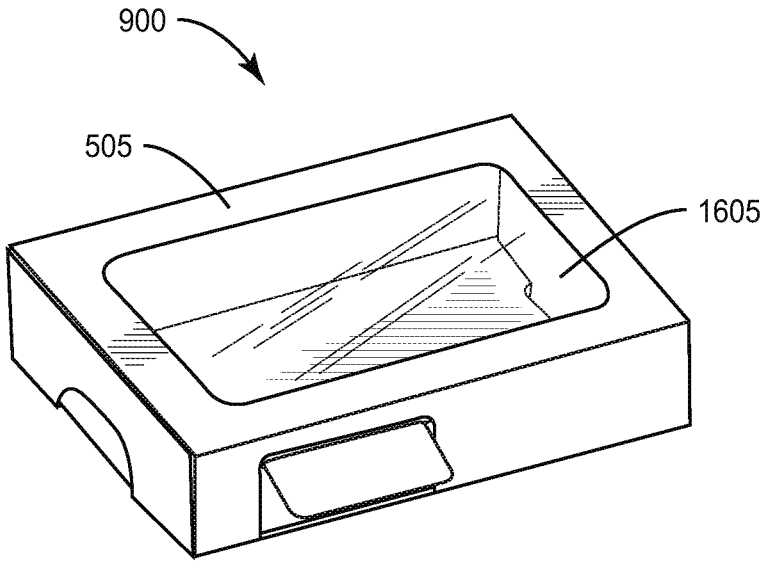
FIG. 16 is a perspective view of a child-resistant package with a window in the outer sleeve, according to various embodiments.
Figure 17:
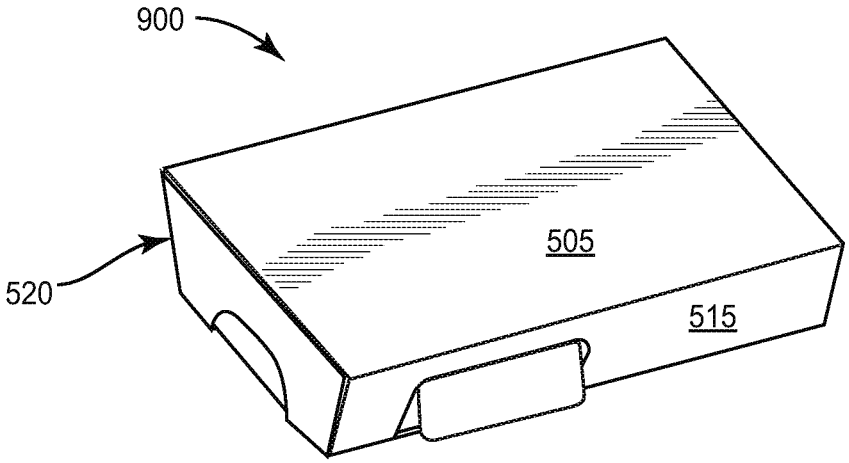
FIG. 17 is a perspective view of a child-resistant package with angled side walls, according to various embodiments.

Although the present disclosure has focused on a child-resistant package 900 having a generally regular rectangular box shape, one skilled in the art will readily recognize that a variety of shapes and features of the child-resistant package 900 are possible and are all within the scope of the present disclosure. FIGS. 16-20 illustrate exemplary, non-limiting embodiments of a variety of shapes and features of the child-resistant package 900. FIG. 16 illustrates a child-resistant package 900 with a window 1605 positioned in the outer sleeve upper panel 505 so that the contents of the child-resistant package 900 may be viewed without opening the child-resistant package 900. While only one window 1605 is shown, any number of windows 1605 may be placed in any position on any panel or side wall of the outer sleeve 500. FIG. 17 illustrates a child-resistant package 900 with angled first and second side walls 515, 520 (as opposed to first and second side walls 515, 520 generally perpendicular to the upper and lower panels 505, 510). Thus, the child-resistant package 900 may take on any desired shape, such as circular, oval, triangular, or any other regular or irregular shape.

Figure 18A:
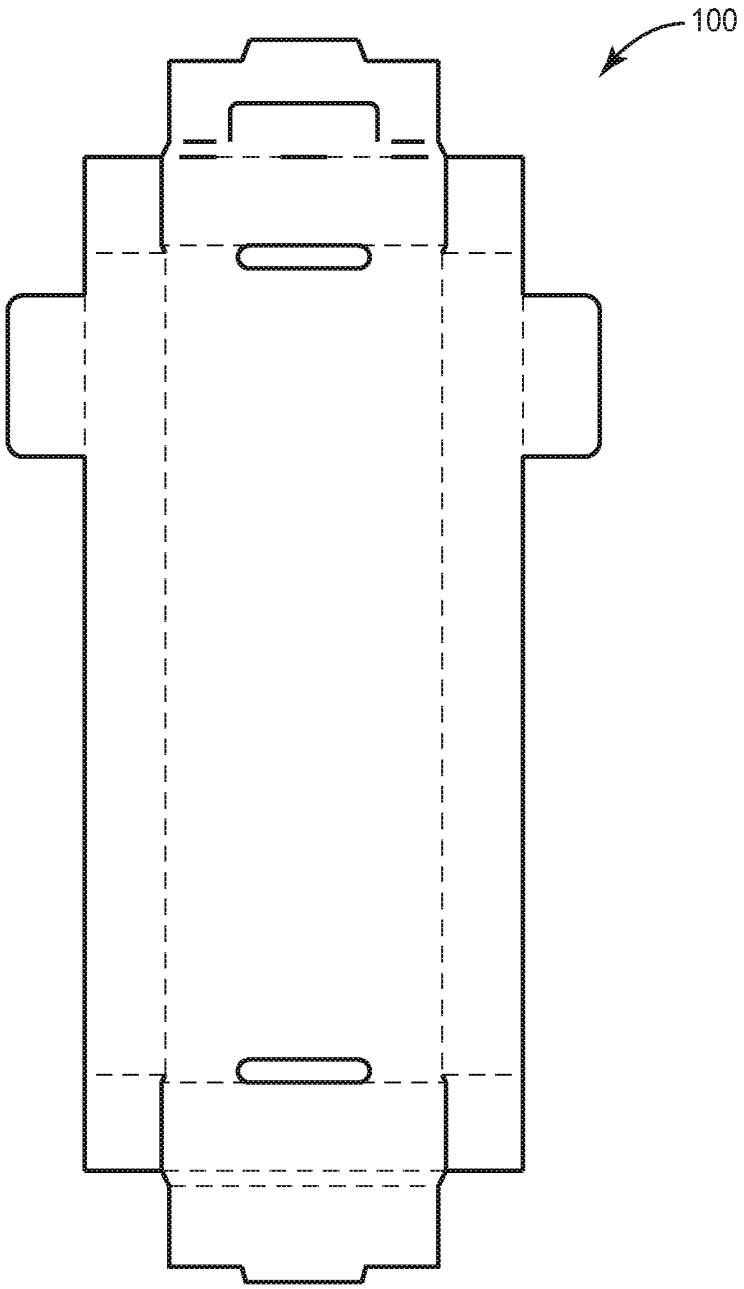
FIG. 18A is a plan view of an inner tray blank, according to various embodiments.
Figure 18B:
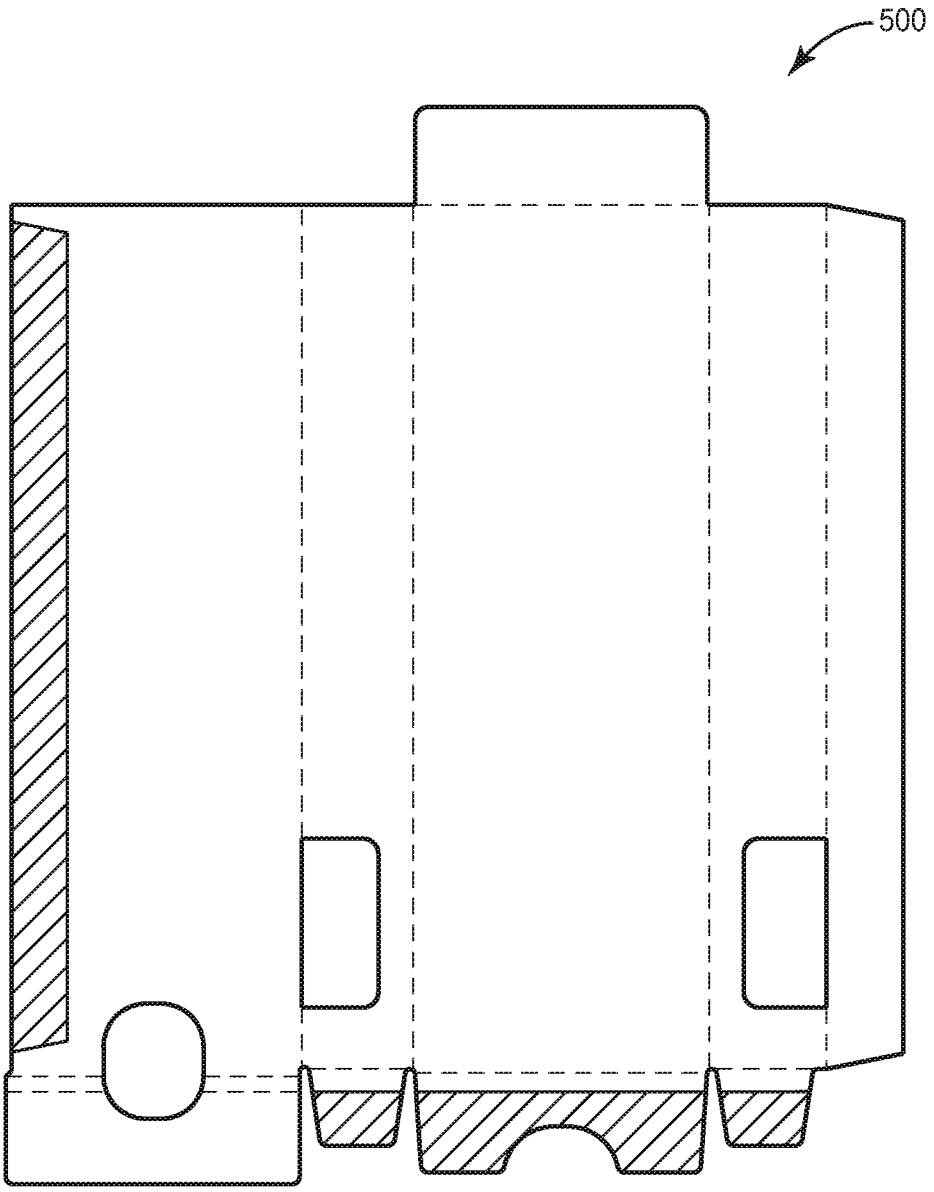
FIG. 18B is a plan view of an outer sleeve blank, according to various embodiments.
Figure 18C:
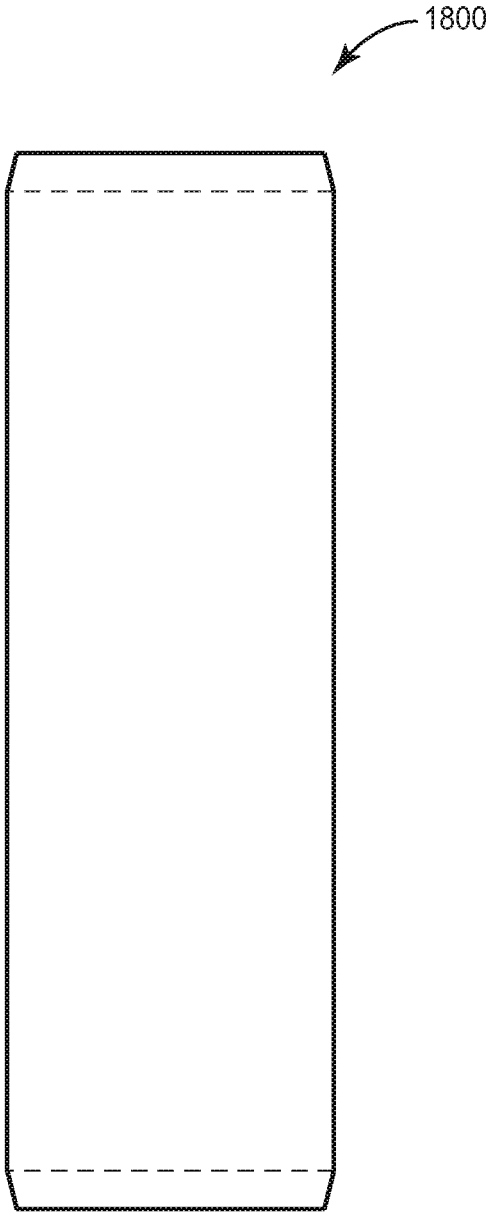
FIG. 18C is a plan view of an inner tray insert blank, according to various embodiments.
Figure 19A:
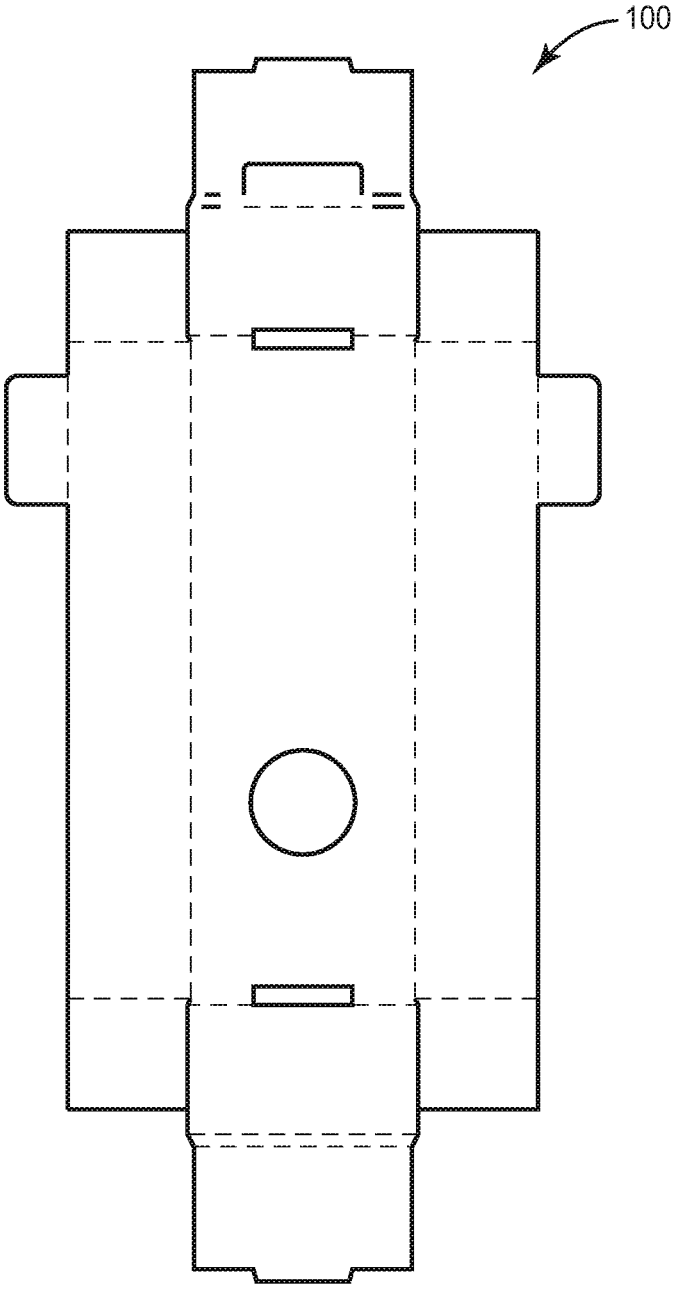
FIG. 19A is a plan view of an inner tray blank, according to various embodiments.
Figure 19B:
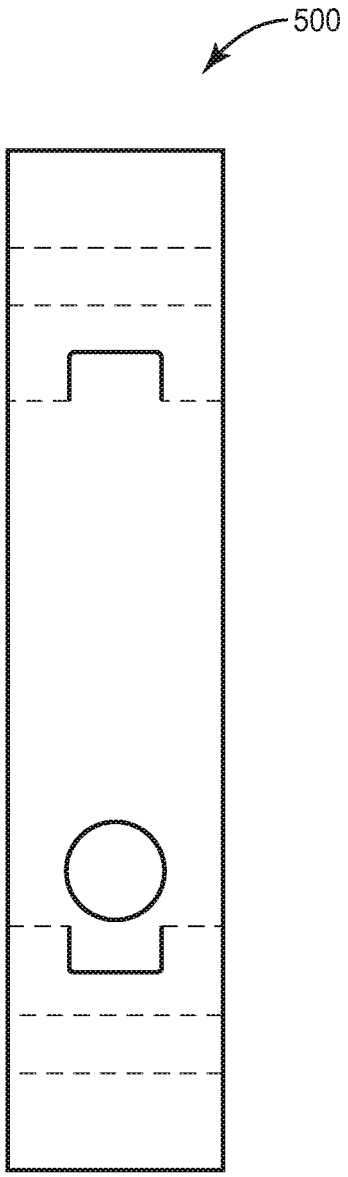
FIG. 19B is a plan view of an outer sleeve blank, according to various embodiments.
Figure 20A:
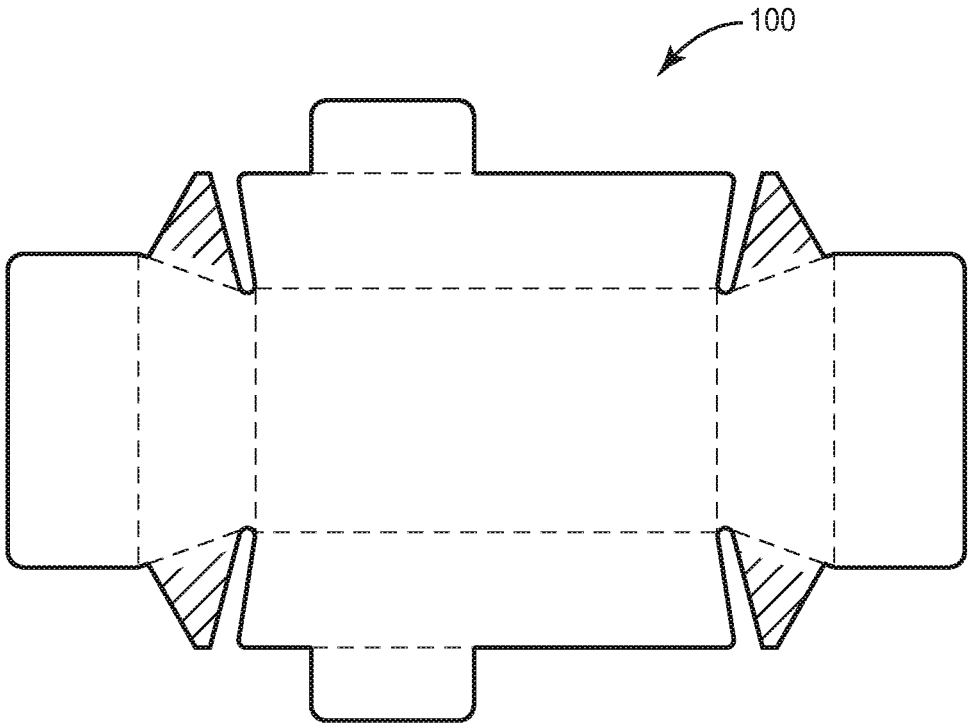
FIG. 20A is a plan view of an inner tray blank, according to various embodiments.
Figure 20B:
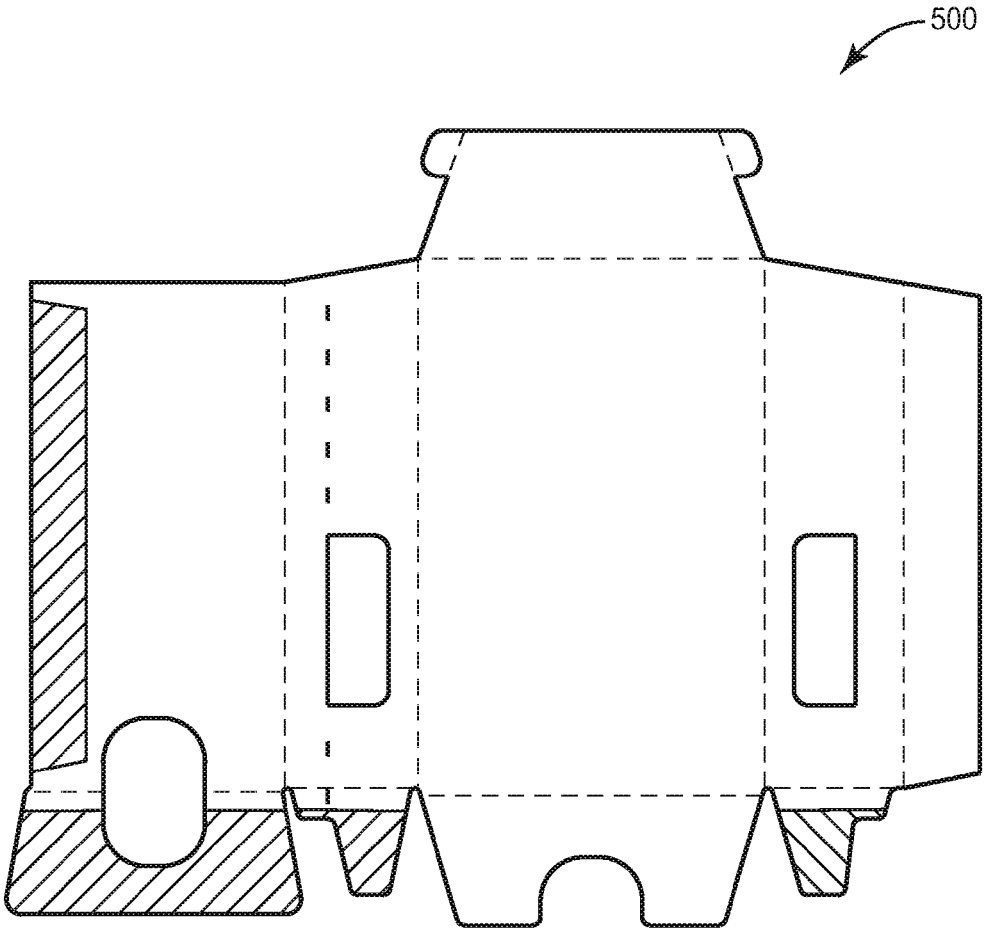
FIG. 20B is a plan view of an outer sleeve blank, according to various embodiments.
Figure 20C:
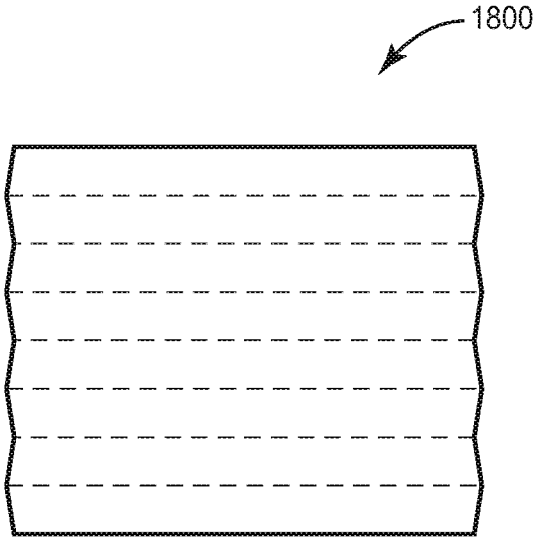
FIG. 20C is a plan view of an inner tray insert blank, according to various embodiments.

FIGS. 18A through 18C illustrate blanks for the inner tray 100, outer sleeve 500, and insert 1800, respectively, for a child-resistant package 900 with an elongated rectangular shape according to various embodiments. The insert 1800 may be used to line one or more surfaces of the inner tray 100. FIGS. 19A and 19B illustrate blanks for the inner tray 100 and outer sleeve 500, respectively, for a child-resistant package 900 in which the inner tray 100 comprises a hole to aid in dispensing a product from the inner tray 100. FIGS. 20A through 20C illustrate blanks for the inner tray 100, outer sleeve 500, and insert 1800, respectively, for the child-resistant package 900 with angled sides as illustrated in FIG. 17. The insert 1800 may have a corrugated shape useful for holding articles with an elongated, slender shape such as cigarettes, matches, and insulin injection syringes desirably stored in a child-resistant package 900.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

The terminology used herein is for the purpose of describing particular embodiments only and is not intended to be limiting of the present disclosure. As used herein, the singular forms "a," an and the are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

What is claimed is:

1. A child-resistant package, comprising:

an inner tray;

an outer sleeve to receive the inner tray therein;

locking tabs coupled on opposite sides of the inner tray; and locking slots on opposite sides of the outer sleeve and aligned with the locking tabs when the inner tray is slideably engaged with the outer sleeve, the locking tabs comprising memory properties to allow the locking tabs to releasably engage the locking slots when the inner tray engages the outer sleeve, the locking tabs further comprising a corrugated material having flutes oriented in a flute direction, the memory properties being obtained by folding the locking tabs against the flute direction.

2. The package of claim 1, wherein the inner tray comprises opposing side walls and at least one of the locking tabs is hingedly coupled to an upper edge of each inner tray side wall.

3. The package of claim 2, wherein the locking tabs are adapted to fold flush to each of the inner tray side walls when the inner tray is initially slideably engaged with the outer sleeve, and the memory properties causing the locking tabs to extend outward through the locking slots when the inner tray is fully engaged with the outer sleeve.

4. The package of claim 2, wherein the memory properties orient the locking tabs at an angle greater than 0 degrees and less than 90 degrees relative to the inner tray side wall.

5. The package of claim 2, wherein the inner tray further comprises opposing end walls disposed between the opposing side walls, and a first tethering panel extending from one of the end walls.

6. The package of claim 5, wherein the outer sleeve further comprises opposing side walls and opposing top wall and bottom wall disposed between the opposing side walls, and a second tethering panel extending from one of the top wall and bottom wall, the second tethering panel positioned to interlock with the first tethering panel when the inner tray is slideably disengaged with the outer sleeve, thereby arresting movement of the inner tray while a portion of the inner tray is within the outer sleeve.

7. The package of claim 1, wherein the outer sleeve further comprises an engagement point that together with the locking tabs and locking slots comprise a locking system, and disengagement of the locking system requires a simultaneous application of force to the locking tabs and the engagement point such that the locking tabs disengage from the locking slots and the inner tray slideably disengages from the outer sleeve.

8. The package of claim 1, wherein the flutes are at least one of flute sizes A (108+/−10 flutes per linear meter), B (154+/−10 flutes per linear meter), C (128+/−10 flutes per linear meter), and D (208+/−13 flutes per linear meter).

9. The package of claim 1, wherein the against the flute direction is substantially perpendicular to the flute direction.

10. A child-resistant package, comprising:

an inner tray comprising opposing side walls and opposing end walls disposed between the side walls;

an outer sleeve comprising an opening adapted to receive the inner tray therein, and an end panel opposite the opening; and a locking system comprising:

at least one locking tab hingedly coupled to each inner tray side wall and angularly disposed to the side wall;

locking slots on opposite sides of the outer sleeve and aligned with each locking tab when the inner tray is slideably engaged with the outer sleeve such that each locking tab engages the locking slot;

an engagement point on the outer sleeve end panel; and the at least one locking tab comprising memory properties to allow the locking tab to releasably engage the locking slot when the inner tray engages the outer sleeve, the at least one locking tab comprising a corrugated material having flutes oriented in a flute direction, wherein the memory properties are obtained by folding the at least one locking tab against the flute direction.

11. The package of claim 10, wherein disengagement of the locking system requires a simultaneous application of force to the at least one locking tab and the engagement point such that the at least one locking tab disengages from the locking slot and the inner tray slideably disengages from the outer sleeve.

12. The package of claim 10, wherein the at least one locking tab is hingedly coupled to an upper edge of the inner tray side wall.

13. The package of claim 10, wherein the at least one locking tab is adapted to fold flush to the inner tray side wall when the inner tray is initially slideably engaged with the outer sleeve, and the memory properties causing the at least one locking tab to extend outward through the locking slot when the inner tray is fully engaged with the outer sleeve.

14. The package of claim 10, wherein the memory properties orient the at least one locking tab at an angle greater than 0 degrees and less than 90 degrees relative to the inner tray side wall.

15. The package of claim 10, wherein the inner tray further comprises a first tethering panel extending from one of the end walls.

16. The package of claim 15, wherein the outer sleeve further comprises a second tethering panel disposed within the outer sleeve, the second tethering panel positioned to interlock with the first tethering panel when the inner tray is slideably disengaged with the outer sleeve, thereby arresting movement of the inner tray while a portion of the inner tray is within the outer sleeve.

17. The package of claim 10, wherein the against the flute direction is substantially perpendicular to the flute direction.

18. A child-resistant package, comprising:

an inner tray comprising opposing side walls, opposing end walls, and a floor panel coupling the side walls and the end walls;

at least one locking tab hingedly coupled to an upper edge of each of the inner tray side walls such that each locking tab is in a first position angularly disposed to the inner tray side wall, the locking tabs having memory properties such that the locking tabs substantially return to the first position after being moved to a second position, the locking tabs comprising paperboard, the paperboard having a grain, the grain oriented in a grain direction, wherein the memory properties are obtained by folding the locking tabs against the grain direction;

an outer sleeve comprising opposing side walls and opposing top and bottom panels disposed between the outer sleeve side walls and defining an opening adapted to receive the inner tray therein, and an end panel opposite the opening comprising an engagement point; and a locking slot in each of the outer sleeve side walls adapted to receive the locking tabs therein when the inner tray is slideably engaged with the outer sleeve, and disengagement of the inner tray requires a simultaneous application of force to the locking tabs and the engagement point such that the locking tabs disengage from the locking slots and the inner tray slideably disengages from the outer sleeve.

19. The package of claim 18, wherein the locking tabs are hingedly coupled to an upper edge of each inner tray side wall.

20. The package of claim 18, wherein the locking tabs are adapted to fold flush to each of the inner tray side walls when the inner tray is initially slideably engaged with the outer sleeve, and the memory properties causing the locking tabs to extend outward through the locking slots when the inner tray is fully engaged with the outer sleeve.

21. The package of claim 18, wherein the memory properties orient the locking tabs at an angle greater than 0 degrees and less than 90 degrees relative to the inner tray side wall.

22. The package of claim 18, wherein the inner tray further comprises a first tethering panel extending from one of the end walls.

23. The package of claim 22, wherein the outer sleeve further comprises a second tethering panel disposed within the outer sleeve, the second tethering panel positioned to interlock with the first tethering panel when the inner tray is slideably disengaged with the outer sleeve, thereby arresting movement of the inner tray while a portion of the inner tray is within the outer sleeve.

24. The package of claim 18, wherein the against the grain direction is substantially perpendicular to the grain direction.

25. The package of claim 18, wherein thickness of the paperboard is from between 0.012 inches and 0.030 inches.

26. A child-resistant package, comprising:

an inner tray;

an outer sleeve to receive the inner tray therein;

locking tabs coupled on opposite sides of the inner tray; and locking slots on opposite sides of the outer sleeve and aligned with the locking tabs when the inner tray is slideably engaged with the outer sleeve, the locking tabs comprising memory properties to allow the locking tabs to releasably engage the locking slots when the inner tray engages the outer sleeve, the locking tabs comprising paperboard, the paperboard having a grain, the grain oriented in a grain direction, wherein the memory properties are obtained by folding the locking tabs against the grain direction.

27. The package of claim 26, wherein the inner tray comprises opposing side walls and at least one of the locking tabs is hingedly coupled to an upper edge of each inner tray side wall.

28. The package of claim 27, wherein the locking tabs are adapted to fold flush to each of the inner tray side walls when the inner tray is initially slideably engaged with the outer sleeve, and the memory properties causing the locking tabs to extend outward through the locking slots when the inner tray is fully engaged with the outer sleeve.

29. The package of claim 26, wherein the outer sleeve further comprises an engagement point that together with the locking tabs and locking slots comprise a locking system, and disengagement of the locking system requires a simultaneous application of force to the locking tabs and the engagement point such that the locking tabs disengage from the locking slots and the inner tray slideably disengages from the outer sleeve.

30. The package of claim 26, wherein the against the grain direction is substantially perpendicular to the grain direction.

* * * * *